US006755557B2

(12) United States Patent
Stauner et al.

(10) Patent No.: US 6,755,557 B2
(45) Date of Patent: Jun. 29, 2004

(54) LIGHTING FIXTURE

(75) Inventors: Joseph Stauner, Algonquin, IL (US); Gerald Kubaszko, Bartlett, IL (US)

(73) Assignee: Juno Manufacturing, Inc., Des Plaines, IL (US)

( * ) Notice: Subject to any disclaimer, the term of this patent is extended or adjusted under 35 U.S.C. 154(b) by 0 days.

(21) Appl. No.: 09/934,497

(22) Filed: Aug. 22, 2001

(65) Prior Publication Data

US 2002/0064047 A1 May 30, 2002

Related U.S. Application Data

(60) Provisional application No. 60/227,191, filed on Aug. 23, 2000.

(51) Int. Cl.[7] ..... F21V 17/00

(52) U.S. Cl. ..... 362/364; 362/221; 362/249; 362/250; 362/147; 362/238; 362/239; 362/287

(58) Field of Search ..... 362/226, 221, 362/365, 366, 249, 250, 248, 147, 238, 239, 404, 407, 408, 148, 150, 287, 427

(56) References Cited

U.S. PATENT DOCUMENTS

| | | | | | |
|---|---|---|---|---|---|
| 2,288,939 | A | * | 7/1942 | Curtis | 362/147 |
| 4,385,346 | A | * | 5/1983 | Spicer | 362/147 |
| 4,729,080 | A | | 3/1988 | Fremont | |
| 4,972,339 | A | | 11/1990 | Gabrius | |
| 5,222,800 | A | | 6/1993 | Chan | |
| D394,424 | S | | 5/1998 | Wachter | |
| 6,015,222 | A | | 1/2000 | Schindler | |
| 6,082,032 | A | | 7/2000 | Gabrius et al. | |
| 6,082,878 | A | | 7/2000 | Daubek | |
| 6,095,660 | A | * | 8/2000 | Moriyama et al. | 362/147 |
| 6,095,669 | A | | 8/2000 | Cho | |
| 6,170,967 | B1 | * | 1/2001 | Usher et al. | 362/394 |
| 6,244,733 | B1 | * | 6/2001 | Fong et al. | 362/147 |

* cited by examiner

*Primary Examiner*—Stephen Husar
*Assistant Examiner*—Bertrand Zeade
(74) *Attorney, Agent, or Firm*—Sonnenschein Nath & Rosenthal LLP

(57) ABSTRACT

Disclosed is a lighting fixture that provides easy lamp replacement and blocks the view of the back wiring.

14 Claims, 5 Drawing Sheets

LIGHTING FIXTURE

CROSS RELATED APPLICATION

This application claims the benefit of the earlier filing date of a provisional application Serial No. 60/227,191, filed 23 Aug. 2000, the disclosure of which is incorporated by reference.

TECHNICAL FIELD OF THE INVENTION

The invention generally involves lighting fixtures.

BACKGROUND OF THE INVENTION

Overhead lighting is often used, especially in a commercial environment, to emphasize various features within a room. In the commercial setting, overhead lighting may be used to accent floor items, such as displays, or wall items, such as paintings. In addition, the strategic placement of overhead lighting may create a certain ambiance.

One problem with overhead lighting is that positioning the light may involve construction-engineering problems. For example, some lighting may be placed only where overhead joists or beams travel, which may not be optimal. One solution for this is to create positionable lights that can be moved periodically. However, the mere movement of the light does not solve the problem of the location of the lighting itself as being confined to the joist area.

Another problem with overhead lighting is that if multiple lamps are used, then positioning these lights is problematic. For example, in those fixtures where the lamps are immobile, the plurality of lamps face in the same direction and independent action of an individual lamp is not possible. In addition, using multiple lamps also involves increased wiring difficulties. Since overhead lighting is by definition, overhead, then a customer walking under the light fixture will see the wiring behind the light. To date, in multiple lamp assemblies no aesthetically pleasing lighting fixture exists that permits easy lamp replacement in conjunction with blocking the view of the back wiring.

SUMMARY OF THE INVENTION

The foregoing problems are solved and a technical advance is achieved by the present invention. Disclosed is a lighting fixture that provides easy lamp replacement and/or ballast transformer replacement, and blocks the view of the back wiring.

DETAILED DESCRIPTION OF THE INVENTION

Figure 1:
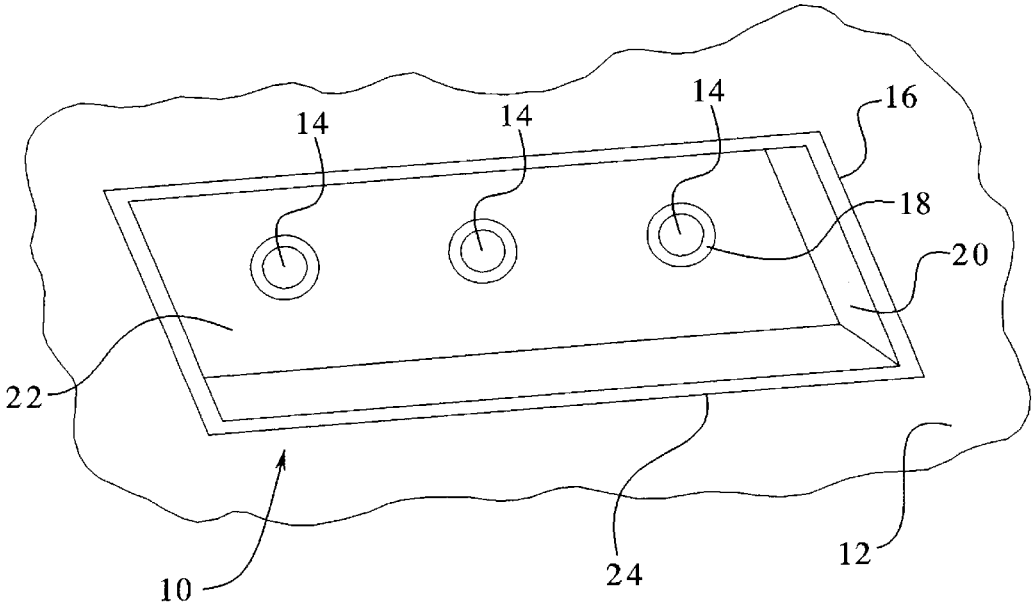
FIG. 1 is an front view of the present invention.
Figure 2:
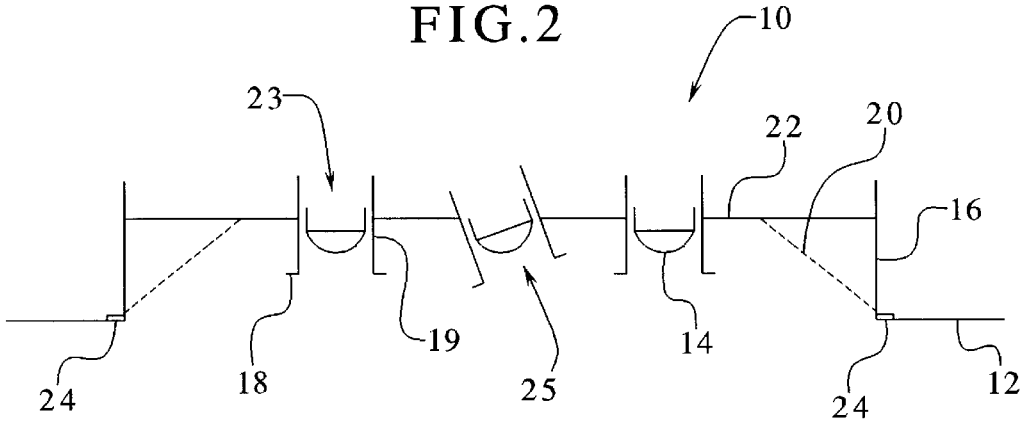
FIG. 2 is a cross sectional view of one aspect of the present invention.

FIG. 1 demonstrates a front view of the present invention. Shown is the lighting assembly 10 attached to ceiling 12. When a person is walking along and looks up, the person will see that the lamp assembly 10 is generally flush with ceiling 12. The person will also see a plurality of lights in the assembly 10, and more particularly, will see a plurality of lamps 14. The person will also see that the assembly may include a pan 16 that serves, inter alia, as a housing for the individual lights. The light may also be designed in such a manner to provide a light baffle 18, which can be so adapted to alter the lighting characteristics, such as reflection, aesthetically pleasing lines, or colorings. The baffle may also be used to absorb light, deflect light, serve as a decorative feature, or generally create a clean look to the light. The pan 16 houses the individual lights in which the lights are placed in a plurality of pan apertures 19 (FIG. 2). Optionally provided with pan 16 is a pan baffle 20, which like the light baffle 18, may also provide changes to the lighting, aesthetically pleasing lines, colorings, or the like. Similarly, pan 16 also includes a pan back 22 in which the pan apertures 19 extend therethrough (FIG. 2). The pan back 22 may be designed to provide various contours or shapes to enhance the functions of the assembly 10. To maintain an aesthetically pleasing look, the pan 16 may also include a pan trim 24, which serves several functions, including aesthetics or may also serve to secure the pan to the ceiling 12. In this regard, the pan trim 24 can sit flush with the ceiling 12 and also may include a way to secure the pan trim 24 to the ceiling 12; the securing mechanism being well known to those of ordinary skill in the art. It should be appreciated that in any embodiment, the product can be used in ceilings or wall installations.

FIG. 2 demonstrates a cross sectional view of the assembly grossly described in FIG. 1. Shown is assembly 10 that sits in a recess in the ceiling 12 such that the assembly is flush with the ceiling 12. Of course the assembly need not be flush. The assembly may be adapted to jut out of the ceiling, such as a sloped ceiling, to provide a different lighting style. In addition, any embodiment described herein may also include a moveable light 25. A moveable light 25 can be any one or more of the plurality of lights in the assembly 10. As shown in FIG. 2, moveable light 25 is the center light and is angled to demonstrate its movement, in either the rotational or angular motion.

FIG. 2 also shows that the individual lights may include a lamp baffle 18 such that it can be of uniform or separate construction. The lamp baffle 18 may be constructed in accordance with U.S. Pat. No. 4,729,080, to Juno Lighting Corp. (Des Plaines, Ill.) the disclosure of which is incorporated herein by reference.

FIG. 2 also demonstrates that pan aperture 19 has a diameter that is slightly larger than the lamp. In this regard, the person walking below when looking up will only see the lamp itself. The pan 16 blocks the back end 23 of the lamp. By varying the size of the pan aperture 19, an aesthetically pleasing configuration is obtained. In the embodiment of FIG. 2, the pan aperture is larger than the diameter of the lamp baffle 18. In embodiments where the lamp baffle 18 is not present, then the pan aperture 19 can be slightly larger than the diameter of the lamp itself. Furthermore, where additional components are used, the diameter of the pan aperture may be larger than the diameter of the lamp and component assembly.

The lamps may also include modular lamp assembly. For example, each lamp may be provided with a spin ring, a ring housing, and ring mounts to the lamp housing such that the ring assembly may be easily snapped or otherwise connected to the pan 16. Such assembly can be made in accordance with processes known in the art, such as U.S. Pat. No. 6,095,669, and U.S. Pat. No. 6,015,222, the entire disclosures of which are expressly incorporated by reference. This is different from other recessed lights in which the recessed lamps generally shine straight down. Therefore, the lamps may be secured via a lamp housing and ring assembly to the pan, or in some other embodiments, to the wireway cover, or the housing 60. In this regard, the fixture provides the benefits of adjustability of the lamps to shine at angles or accent, plus the modularity of the lamps to permit easier relamping, combined with the recessed lighting effect. In effect, this permits a click and place, or plug and place feature.

Furthermore, each individual lamp may also include a lamp cartridge, which may permit easy removal of the lamps. Lamp cartridges are known in the art. In this regard, the invention permits greater ease in lamp change.

Moreover, the lamp modularity also comprises means for changing the lenses or adding filters. The lamp housing may also comprise connectors, such as springs, rods, flanges, or the like to secure various lamps, lenses, filters, or the like to the fixture.

Figure 3:
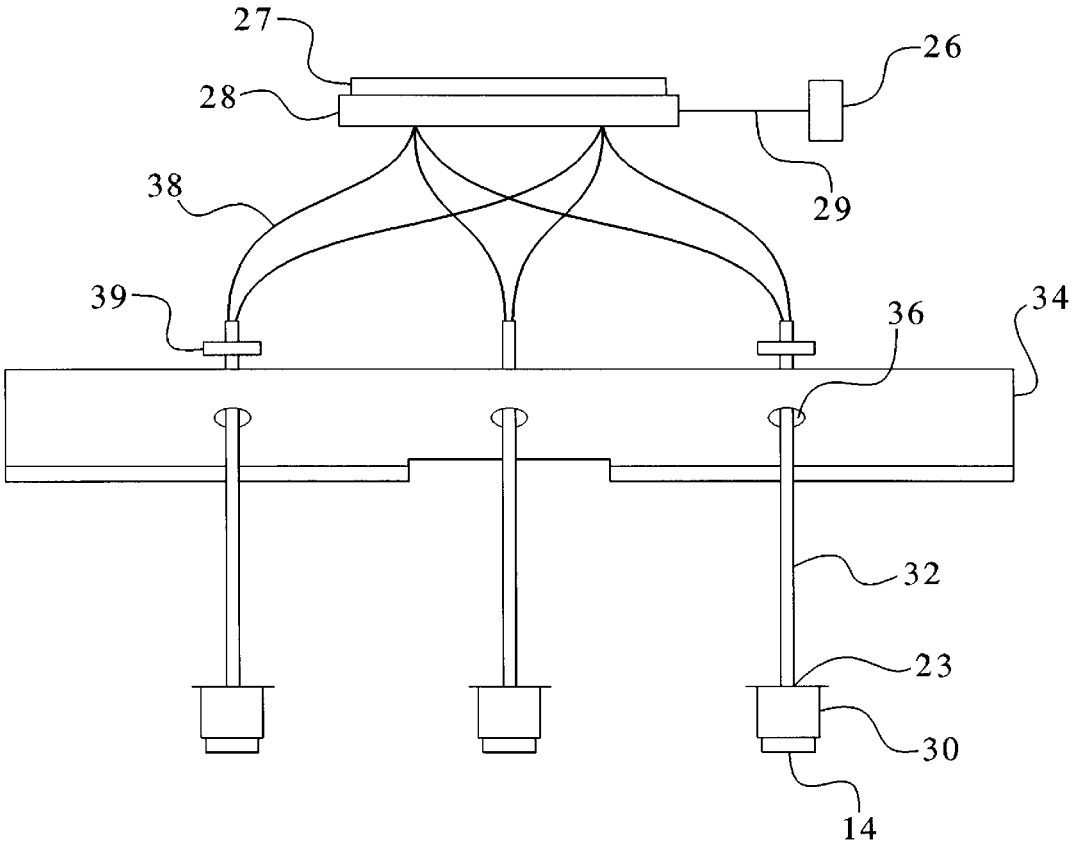
FIG. 3 is a wiring diagram view of another aspect of the present invention.

FIG. 3 demonstrates yet another embodiment. In this view, shown is a power source 26 connected to a transformer 28 via power-source-transformer circuit 29. As known in the art, the transformer 28 may be used to step up/down the voltage, or cause a circuit type switch from AC to DC or vice versa. The transformer 28 may be mounted via various configurations to provide quick and easy removal or to permit easy and quick ballast removal. Not all lamps need be connected to the same transformer 28 as the invention contemplates the use of multiple or single transformers for few or all the lamps. In addition, the use of multiple transformers may permit easier replacement. For example, transformer 28 may be mounted on special plates to provide this.

The transformer 28 is easily serviceable from the room side or from above. The transformer 28 may be mounted on a mounting plate 27. In this regard, if servicing the transformer from one side, the technician may need to remove the transformer 28 only. But if the technician approaches from the other side, the technician may need to remove both the transformer and plate together.

In FIG. 3, the light is shown in greater detail showing a lamp 14 being connected to socket 30. The socket 30 has wiring extending from a back end, such as a back end 23, which provides the power source for lamp illumination. The wiring may be contained in a socket sleeve 32, which may comprise any type of material as desired. In this embodiment, a wireway cover 34 may be used to further help disguise or hide the wiring. In other embodiments, it may provide additional structural support to the pan 12, or to provide another mechanism of attachment to the ceiling or any joists or beams. The assembly may also be attached using the system described in U.S. Pat. No. 5,222,800 to Chan, the disclosure of which is expressly incorporated by reference. The socket sleeve 32 containing the wiring may travel through the wireway cover 34 via a wireway cover aperture 36. As mentioned herein, the wireway cover 34 may also include heat dissipation vents. Again, this aperture 36 may be configured to hug against the sleeve 32 and further provide a blocking of the circuitry from the passerby's line of sight. As with any electrical component, the socket 30 receives its power via a plurality of socket wiring 38, which in turn may connect directly to the power source 26 or to the transformer 28. Although not shown, pan 16 may be interposed between the socket 30 and wireway cover 34.

In addition, the socket sleeve 32 may also include a strain relief piece 39, which may be a disc or plate. In one embodiment, the strain relief piece may be situated anywhere along the wiring to minimize the strain on the electrical connections. For example, the strain relief piece may prevent strain on the electrical connections within the wireway cover.

In another embodiment, the piece 39 may be positioned between the power source 26 and the wireway cover 34 or pan 16 so that the downward pull of the lamps forces the piece 39 against the pan 16 or cover 34 thereby having the piece 39 support the lamps. In this regard, the piece 39 can be so configured (square, rounded, grooved) to support the lamps. For example, piece 39 can be a disc or plate that is larger than the either the diameter of the wireway cover aperture 36 or the pan aperture 19.

Figure 4:
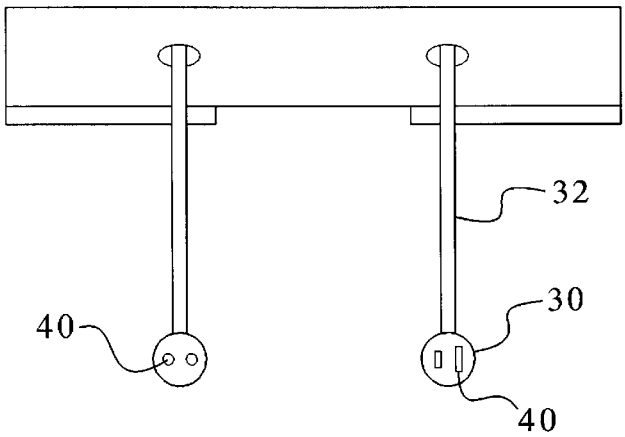
FIG. 4 is a view of the lighting socket assembly.
Figure 5A:
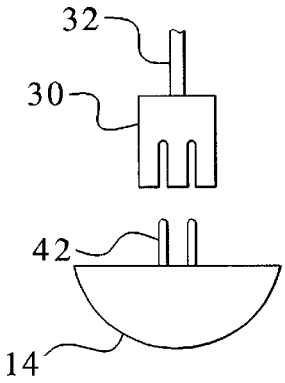
FIGS. 5A–C depict alternate embodiments of the lighting sockets.
Figure 5B:
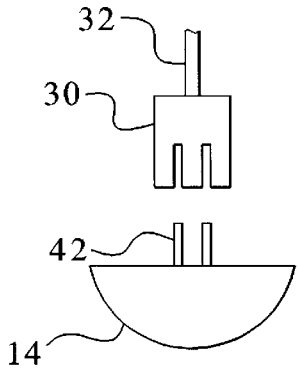
Figure 5C:
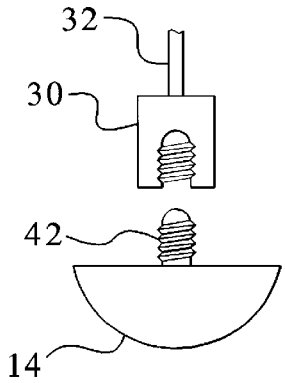

FIGS. 4 and 5 demonstrate a view of the socket 30. The socket 30 can be provided with a plurality of configurations to accept connection with the lamp 14. For example, as shown in FIG. 4, socket 30 can be provided with a socket outlet 40, which can be configured, as shown in FIGS. 5A–C, to accept many configurations of lamp prongs 42. These prongs 42 can take various shapes such as pins, extensions, threaded components, rounded, squared, pins, or any other type of male-female connectors, or any other type of connector well known in the art.

Figure 6:
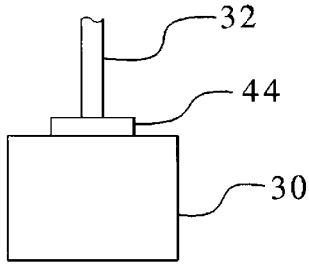
FIG. 6 is a view of the pivot mechanism.

FIG. 6 demonstrates the pivot assembly 44. This assembly may be configured to provide movement of the light, such as rotational, angular, or lateral movement. For example, the pivot may be manufactured in accordance with U.S. Pat. No. 6,082,878, the entire disclosure of which is expressly incorporated by reference.

Figure 7:
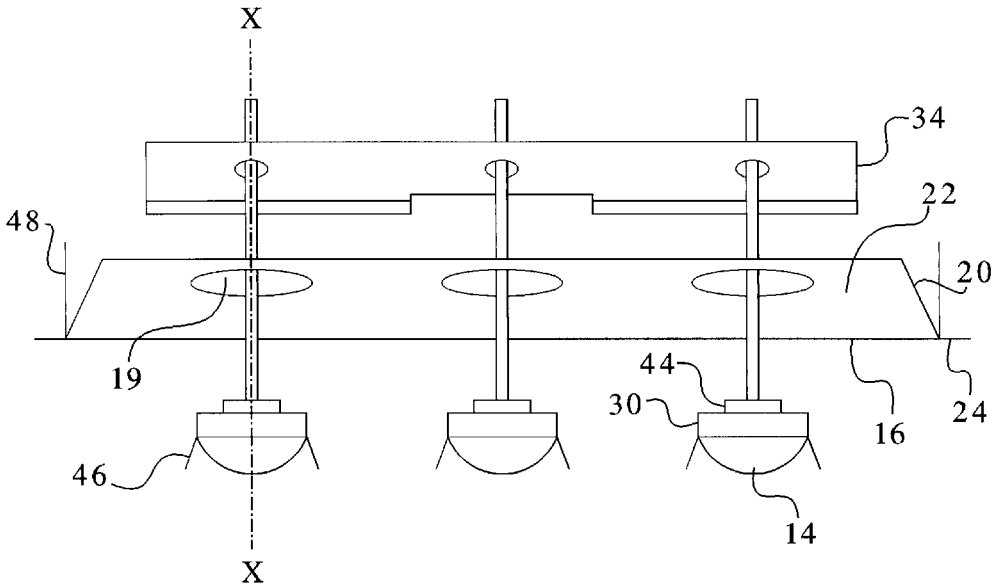
FIG. 7 is an exploded view of the present invention.

As shown in FIG. 7, the first lamp has an imaginary longitudinal axis X extending therethrough. Also shown in this figure is one non-limiting location of the wireway cover 34 in relation to the pan 16. A socket 30, having a socket shield 46, which may be the same as lamp housing, connects to the pivot 44 and the socket sleeve extends through the pan 16. As shown, pan 16 may also include a pan connector 48, which may be used to connect the pan to either the wireway cover 34, ceiling 12, the housing 60 (FIG. 9), or any other structural part of the building, or combination thereof. Pan connector 48 may comprise a mount, rod, pin, or spring. Although not shown, the transformer 28 and power source 26 may connect to the socket 30, but the wiring and assembly may be hidden by the pan plus wireway cover combination. Although also not shown, each or all lights may be configured with pivots 44 to provide the desired movement of the lamps.

Figure 8:
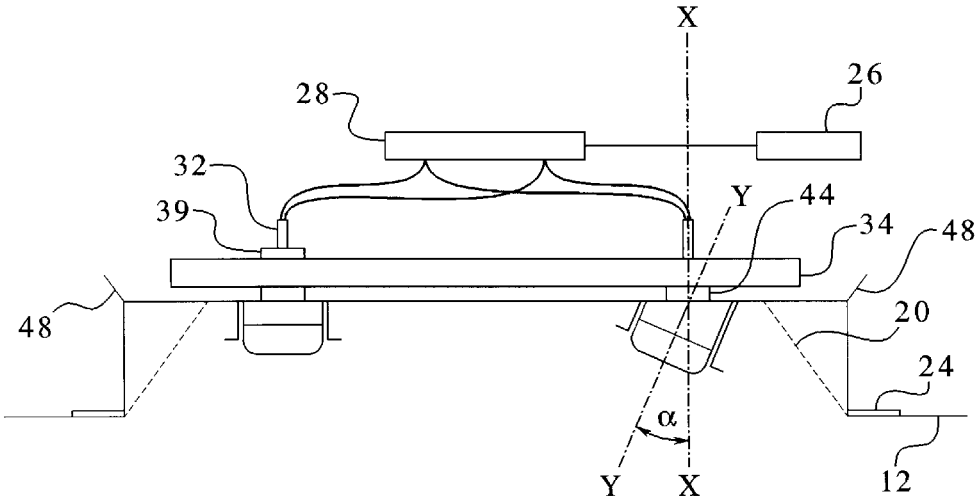
FIG. 8 is another embodiment of the present invention.
Figure 10A:
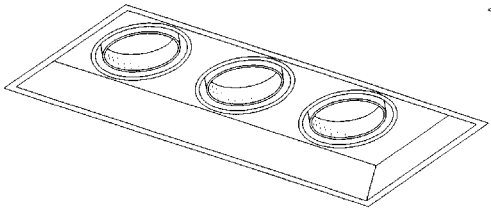
FIGS. 10A–D depict other embodiments of the present invention.
Figure 10C:
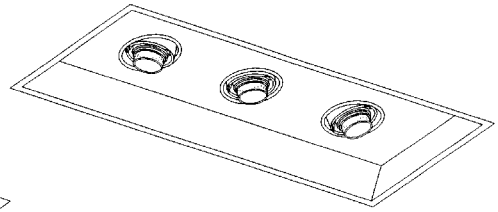
Figure 10B:
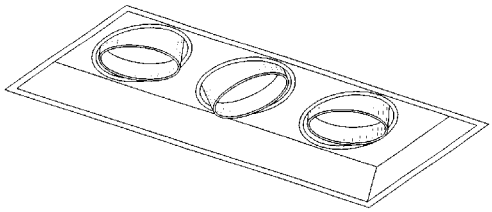
Figure 10D:
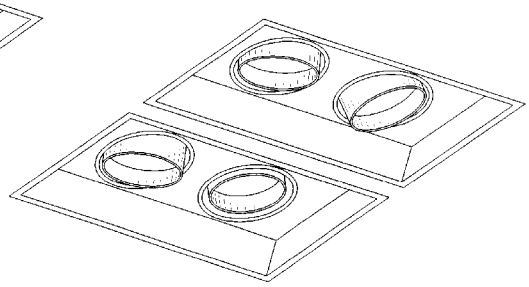

FIG. 8 demonstrates a cross sectional view of the lighting assembly 10. Shown here is that the wireway cover 34 is juxtaposed to the pan 16. Shown in dotted lines is pan baffle 20, shown at angles. However, the pan baffle may be flush against the side or may have an increased angle, depending on the desired lighting effect. Also shown is longitudinal axis X, shown as perpendicular to the ceiling 12. The light may be positioned at various angles, rotations, or lateral/vertical displacements, such as angling it to create an angle $\alpha$ that is the angle between axis Y and longitudinal axis X. In this regard, various lighting configurations may be made as desired.

Figure 9:
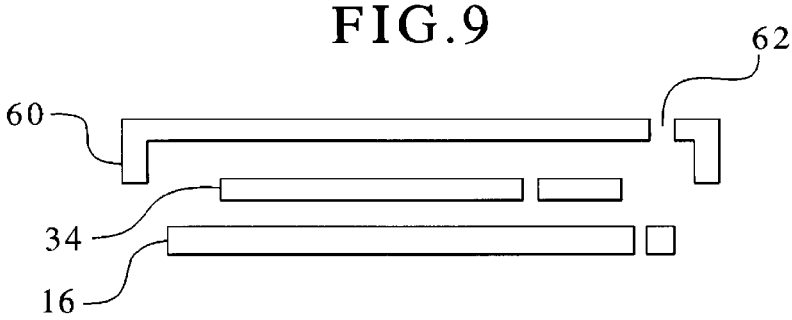
FIG. 9 is another embodiment of the present invention.

FIG. 9 demonstrates yet another embodiment of the present invention. Shown is an intermediate housing 60.

Housing 60 can serve to provide anchorage to the building structure itself, the wireway cover, the pan, or any combination thereof. The housing 60 may be as described in U.S. Pat. No. 4,972,339, issued 20, Nov. 1990 to Gabrius, the disclosure of which is entirely incorporated by reference. In one particular embodiment, the housing 60 may house the wireway cover and may also be provided with special vents 62. These vents may be found across the top and may be used to control temperature that is normally associated with closed fixtures, such as providing heat dissipation in the housing. In addition, a vent may be configured also in the wireway cover 34 and/or the pan 16, and/or the housing.

The housing may be used to connect to the ceiling, the pan, or the wireway cover. In this manner, increased structural support is available. The housing may also be adapted to be used as a layin for T-bar ceilings. In this regard, the housing and fixture assembly may be dropped down onto the T-bar. The housing may also be used in traditional drywall ceilings or drop ceilings.

Thus, when put together, the housing 60 may have an opening therethrough which is closed off partially by the wireway cover or the pan, or both. The pan may therefore mount the lamps. The housing 60 may also be adapted to substantially block the view of the wiring.

In FIGS. 10A–D, shown are the lamps in various configurations when the assembly is put together. Shown also are the lamps set at various angles to provide, for example, a wall wash. In one embodiment, depicted in FIG. 10D, the lamps may be configured to include two lamps within one fixture, further which two fixtures are adjacent. One skilled in the art would appreciate that any number of lamps may be included in one fixture. Similarly, any number of fixtures may be placed adjacent one another.

Figure 11:
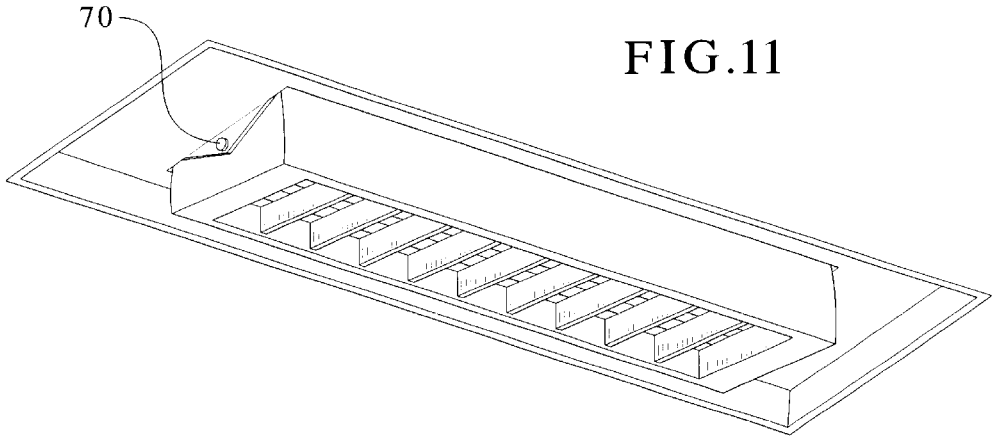
FIG. 11 is yet another embodiment of the present invention.

FIG. 11 describes yet another embodiment. In this configuration a wall wash rectangular fixture is placed. The housing may also include a series of end pivots 70 upon which the fixture will rotate within the housing. A grating or louver may be provided over the plurality of lamps.

While this invention is susceptible to embodiments of different forms as specifically disclosed herein, the invention is not intended to be limited thereto. A person of ordinary skill in the art will recognize that various other configurations may be made without departing from the scope of the invention as described by the appended claims.

We claim:

1. A recessed lighting fixture for creating an aesthetically pleasing and versatile light, comprising:

(a) a plurality of recessed lights, each light having a lamp end and a back end, wherein each light is connected to a pivot, wherein the pivot provides movement in a rotational and angular motion;

(b) the back end further comprising an electrical component comprising electrical wiring extending therefrom;

(c) a barrier disposed between the lamp end and the electrical component, the barrier being adapted to block a view of the electrical component; and (d) the plurality of lights connected to a transformer.

2. The recessed lighting fixture of claim 1, wherein the light further comprises a socket in which the lamp is attached.

3. The recessed lighting fixture of claim 2, wherein the barrier comprises a pan having at least one baffle, the at least one baffle further adapted to alter the light.

4. The recessed lighting fixture of claim 3, wherein the pan further comprises a connector adapted to secure the pan into a ceiling.

5. The recessed lighting fixture of claim 4, wherein a second barrier is generally disposed between the plurality of lights and the transformer such that the second barrier is further adapted to block the view of the transformer.

6. The recessed lighting fixture of claim 5, wherein the plurality of lights are adapted to provide rotational and angular movement.

7. A recessed lighting fixture, comprising:

(a) at least two recessed lights, each light further having a diameter, each light further connected to a socket, each socket further connected to a transformer, wherein each light is connected to a pivot, wherein the pivot provides movement in a rotation and angular motion; and (b) an elongated back pan having an aperture therethrough, the aperture defining an aperture diameter, wherein the aperture diameter is slightly larger than the light diameter to block the view of the transformer.

8. The recessed lighting fixture of claim 7, wherein the elongated back pan is flush against a ceiling thereby blocking view of the transformer.

9. A recessed lighting fixture, comprising:

(a) a lamp housing, the lamp housing including a lamp assembly, the lamp assembly having a spin ring, a ring housing, and a ring mount, wherein the lamp assembly is connected to a pivot, wherein the pivot provides movement in a rotational and angular motion;

(b) the housing being adapted to anchor the housing to a building structure; and (c) wherein the fixture further includes a wireway cover and wireway cover aperture, the cover further including a strain relief piece located between the wireway cover and a power source, and wherein the strain relief piece has an aperture greater than the size of the wireway cover aperture and the strain relief piece aperture is in-line with the wireway cover aperture, to permit electrical wiring to pass through the apertures.

10. The recessed lighting fixture of claim 9 further including a lamp, the lamp having a lamp diameter, and a pan, the pan having a pan aperture diameter slightly greater than the lamp diameter.

11. The recessed lighting fixture of claim 10, wherein the lamp housing comprises a plurality of lamps.

12. The recessed lighting fixture of claim 11, wherein the lamp housing comprises a plurality of lamps that are adapted to be movable in lateral directions.

13. The recessed lighting fixture of claim 11, wherein the fixture also comprises a transformer or ballast adapted to be removed via the pan assembly.

14. The recessed lighting fixture of claim 13, wherein the fixture further comprises at least one of a grating and louver partially or entirely covering the plurality of lamps.

* * * * *